US006248971B1

(12) United States Patent
Morel et al.

(10) Patent No.: US 6,248,971 B1
(45) **Date of Patent: *Jun. 19, 2001**

(54) CIRCUIT BREAKER WITH PARALLEL CONNECTED POLE COMPARTMENTS

(75) Inventors: Robert Morel, Herbeys; Marc Rival, Panissage, both of (FR)

(73) Assignee: Schneider Electric SA (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/293,960

(22) Filed: Apr. 19, 1999

(30) Foreign Application Priority Data

May 12, 1998 (FR) ..... 98 06206

(51) Int. Cl.[7] ..... H01H 33/12
(52) U.S. Cl. ..... 218/157; 218/152
(58) Field of Search ..... 218/2, 7–9, 15, 218/44, 46, 71, 119, 152, 153, 157; 335/8–10

(56) References Cited

U.S. PATENT DOCUMENTS 2,632,826 3/1953 Titus .
4,859,819 * 8/1989 Weldon et al. ..... 361/23
4,884,047 * 11/1989 Baginski et al. ..... 335/10
5,181,164 * 1/1993 Beard et al. ..... 361/345
5,210,385 * 5/1993 Morel et al. ..... 218/7
5,689,097 * 11/1997 Aufermann et al. ..... 218/157

FOREIGN PATENT DOCUMENTS 0320412 6/1989 (EP) .
0322321 6/1989 (EP) .
0437151 7/1991 (EP) .

* cited by examiner

*Primary Examiner*—Lincoln Donovan
(74) *Attorney, Agent, or Firm*—Parkhurst & Wendel, L.L.P.

(57) ABSTRACT

A circuit breaker comprises a plurality of pole compartments juxtaposed inside an insulating case, in each of which compartments there are arranged an arc extinguishing chamber and at least one pair of separable contact parts comprising at least one movable contact part, at least two of said pole compartments being contiguous and separated from one another by a partition. The separating partition of the twinned poles comprises a communicating aperture of dimensions and location such that it is able to appreciably influence the distribution of the arcing energy between the two compartments when the latter are connected in parallel. A circuit breaker with a high breaking capacity is thus obtained from a standard multipole circuit breaker of lower breaking capacity.

11 Claims, 7 Drawing Sheets

CIRCUIT BREAKER WITH PARALLEL CONNECTED POLE COMPARTMENTS

BACKGROUND OF THE INVENTION

The invention relates to a circuit breaker at least one phase of which is formed by several poles mounted in parallel.

The circuit breaker rating, i.e. the value of the rated current of the circuit breaker, is, for a case of predetermined size, determined by the choice of the poles, i.e. essentially by the dimensions of the copper parts associated to the pole.

It is desirable to be able to extend a circuit breaker range by associating circuit breakers comprising a certain number of standard poles so as to obtain, for a minimum additional cost, a circuit breaker of higher rating than that of the conventional poles which make up the circuit breaker. For this purpose, it has been proposed, in the document EP-A-0,320,412, to connect two adjacent poles of a standard circuit breaker in parallel. At least one phase of the circuit breaker is then constituted by two poles, each comprising a stationary contact extended by a contact strip protruding out from the case, a movable contact connected by a flexible conductor to a second contact strip protruding out from the frame, and an arc extinguishing chamber. One connecting strip is fixed to the contact strips of the stationary contacts of the two poles and another connecting strip is fixed to the contact strips of the movable contacts, thus achieving twinning of the two poles.

Experience however shows that when breaking occurs under these conditions, the arcing current does not divide uniformly between the two twinned poles. Very quickly, the arcing current in fact only persists in one of the two breaking chambers. If the ultimate short-circuit breaking capacity assigned to the circuit breaker remains identical to that of the original standard circuit breaker, this phenomenon does not have any drawbacks. If on the other hand a higher breaking capacity is sought for, the arcing energy becomes too great for a single chamber. The twinned pole construction of the state of the technique therefore proves unsuitable for manufacture of a circuit breaker whose breaking capacity is higher than that of the individual circuit breakers which make it up. This is why circuit breakers with high breaking capacity of the state of the technique do not use standard chambers mounted in parallel.

SUMMARY OF THE INVENTION

One object of the invention is therefore to extend a circuit breaker range so as to form, from existing circuit breakers, a circuit breaker of higher rating and breaking capacity than the individual circuit breakers which make it up, with a minimum number of modifications. Another object is to increase the breaking capacity of a circuit breaker with twinned poles.

These objects are achieved according to a first feature of the invention by means of a circuit breaker comprising at least two contiguous pole compartments separated by a partition and juxtaposed inside an insulating case, in each compartment there are arranged an arc extinguishing chamber and a pair of separable contact parts, each contact part of one of the compartments being electrically connected in parallel with a corresponding contact part of the other compartment or able to be connected thereto, a circuit breaker which comprises means for distributing the arcing energy in the two compartments, comprising at least one communicating aperture between the two contiguous compartments, arranged in the partition. In other words, when the opening performances of the compartments connected in parallel with and without an aperture are compared, the distribution of the arcing energy between the two chambers is appreciably more balanced when the aperture exists than when it is absent.

According to a second feature of the invention, these objects are achieved with a circuit breaker comprising at least two contiguous pole compartments separated by a partition and juxtaposed inside an insulating case, in each compartment there are arranged an arc extinguishing chamber and a pair of separable contact parts. The circuit breaker also comprises an operating mechanism linked to the separable contact parts of the two compartments in such a way that their separation is either simultaneous or almost simultaneous. The corresponding contact parts in each compartment are electrically connected in parallel to form a single pole with an ultimate breaking capacity $I_{cu}$ for a given corresponding assigned voltage $v_{cu}$ and power factor $k_{cu}$, wherein said partition comprises at least one communicating aperture between the two contiguous compartments, of dimensions and location such that, when a current of an intensity equal to 50% of the ultimate breaking capacity $I_{cu}$ of the pole for the voltage $v_{cu}$ and power factor $k_{cu}$ is flowing globally through the pole, the ratio between the arcing energy in the least solicited of the compartments and the arcing energy in the other compartment is greater than 1/6, the arcing energy being measured for each compartment by the integral $$W = \int_{t_0}^{t_4} v(t) \cdot i(t) dt$$

where

- v(t) is the instantaneous value of the voltage at the terminals of the contact parts
- i(t) is the instantaneous value of the current intensity flowing through the contact parts
- $t_0$ is the time when separation of the contact parts begins
- $t_4$ is the time when the current intensity flowing through the contact parts is finally cancelled.

The physical phenomena generated by the aperture in the partition separating the two compartments are complex. The presence of the aperture first of all has a thermodynamic aspect: the hot ionized gases at high pressure generated in the compartment whose arc is greater enter the other compartment. This particle movement has various effects some of which are positive and others of which are not. From an energy point of view, the hot gases which have migrated can use the separators of the cooler chamber to cool down, which is beneficial. From an electrical point of view, the presence of ionized gas in the compartment whose arc is weakening or extinguishing tends to revive this arc. From an aerodynamic point of view on the other hand, the gas movements and possible pressure waves from one compartment to the other can have an influence on the movement of the arc foot, and elongation of the arc in each compartment, with a risk of hindering movement of the arc to the arc extinguishing chamber due to the effect of the electrodynamic forces. However this electrodynamic phenomenon, called blowing, is of prime importance to achieve breaking and it is not desirable that its effect be reduced. Likewise, from the point of view of the variation of the pressures in the two compartments, the orifice also appears counterproductive. In fact a pressure decrease occurs in the compartment whose arc is greater and a pressure increase occurs in the other compartment. But theory indicates that a high pressure enhances a decrease of the straight cross-section of the arcing column, and therefore an increase of its electrical resistance and of the arcing voltage. This is moreover one of the main reasons for the existence of arc extinguishing chambers which, by performing a confinement of the arc, enable a considerable increase of the pressure in which the arc is located. Decreasing the pressure in the compartment whose arc is greater therefore means decreasing the arcing voltage and favoring maintenance of the arc.

Globally, in surprising and unpredictable manner, it proves possible to position and calibrate the aperture in such a way that mutual restrikings of the two arcs occur during breaking, which enables the arcing energy to be distributed over the two chambers in significant proportions and a greater absorption capacity to be achieved globally. Naturally the energy distribution is not perfectly balanced, but the important thing is that the energy dissipated in each compartment be of the same order of magnitude, i.e. in a proportion better than 1 for 10. In practice it is about ⅓ to ⅔. This is sufficient to relieve the pole which is more affected by the arc and to increase the breaking capacity of the assembly formed by the two compartments with respect to a single compartment.

Preferably the aperture is situated close to the zone where the arc is drawn in the separation phase of the contact parts. This arrangement provides the advantage of limiting the risk of damage of the contact parts as best as possible. It does in fact ensure that distribution of the arcing energy is effective very early in the opening phase of the contact parts. Furthermore, it should be emphasized that when expansion of the arc takes place in the breaking chamber, the deionization plates are subjected to high electromagnetic stresses perpendicularly to their main plane, which tends to deform them. This phenomenon is an obstacle to widening of the breaking chamber. In practice, the plates used for breaking chambers of large dimensions are more rigid—and therefore thicker for a given material—and are arranged at a larger distance from one another to prevent contact when deformations occur. This has the consequence of the height of the chamber increasing with its width. According to this preferred embodiment of the invention, i.e. by dimensioning the communication orifice in such a way that the separating partition keeps its support function, it becomes possible to widen the chamber without modifying its other dimensions.

According to a preferred embodiment, the arc extinguishing chamber, in each of the contiguous compartments, has a mouth opening out on the side where the contact parts are situated, this mouth being confined on one of its edges by a lower arcing horn designed to receive the foot of the electrical arc at its entry into the chamber, the aperture being disposed and dimensioned in such a way that the lower arcing horns in the contiguous compartments are located directly facing one another on each side of the aperture. This arrangement gives very satisfactory results. According to a complementary arrangement, the mouth of the arc extinguishing chamber opening out on the side where the contact parts are located in each of the contiguous compartments is confined on an edge opposite the lower arcing horn by an upper arcing horn, the aperture being disposed and dimensioned in such a way that the zones situated between the lower arcing horn and the upper arcing horn of each compartment are located directly facing one another on each side of the aperture.

Likewise, the distribution is good when the opening of the aperture in each compartment is located close to the contact zone of the pairs of separable contact parts.

According to a preferred embodiment, the dimensions of the aperture are such that the part of the movable contact parts of each compartment on which the head of the electrical arc is located when separation of the contact parts takes place is facing the corresponding part of the movable contact part in the other compartment, both in the closed position and in the open position.

For circuit breakers whose pairs of separable contact parts comprise a stationary contact part, it may be advantageous for the opening of the aperture in each compartment to be situated close to the stationary contact part.

It is always preferable that the walls of the aperture have a high dielectric strength.

BRIEF DESCRIPTION OF THE DRAWINGS

Other advantages and features of the invention will become more clearly apparent from the following description of different embodiments of the invention, given as non-restrictive examples only and represented in the accompanying drawings.

DETAILED DESCRIPTION OF THE PREFERRED EMBODIMENT

Figure 1:
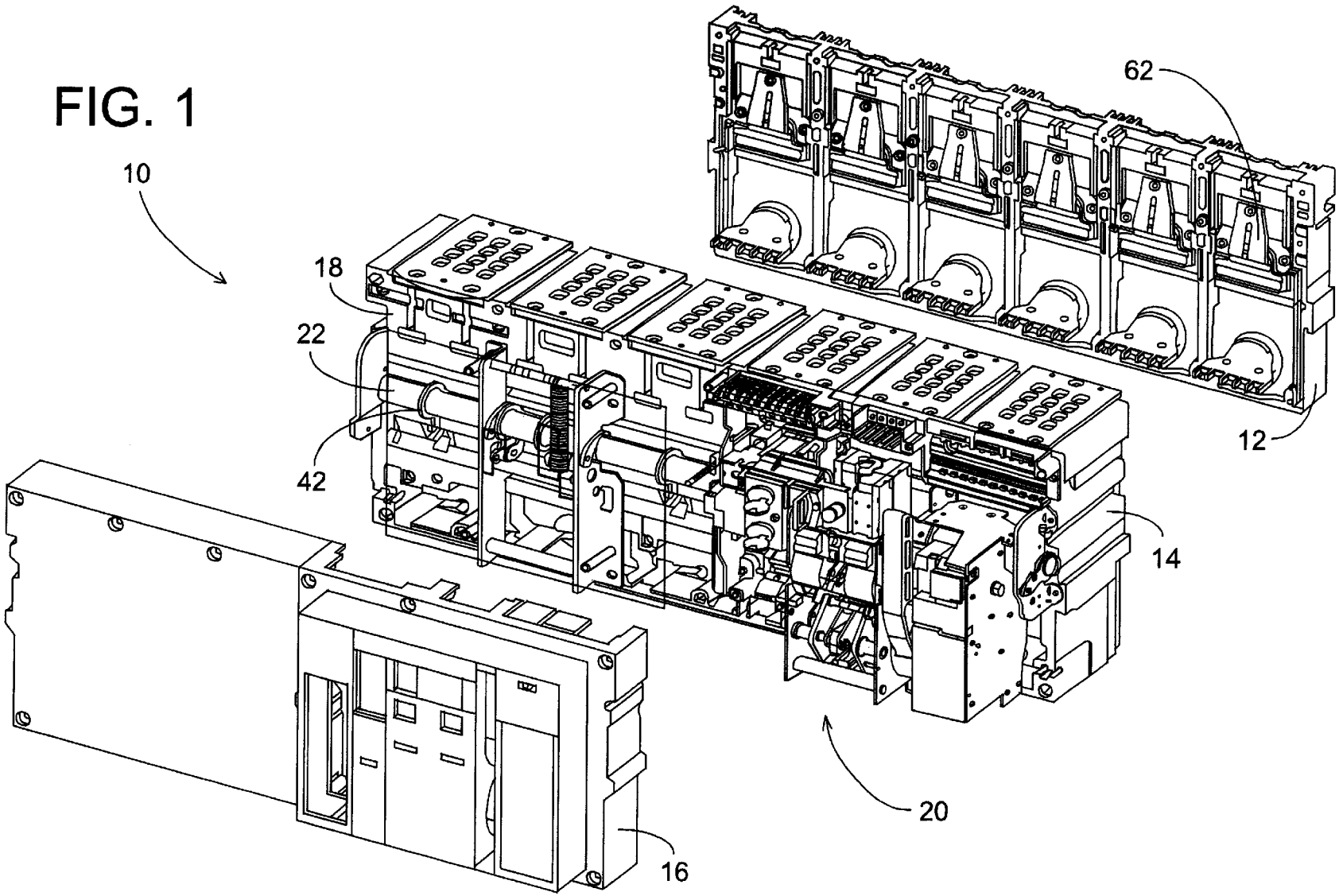
FIG. 1 represents an exploded perspective view of a circuit breaker according to the invention.
Figure 2:
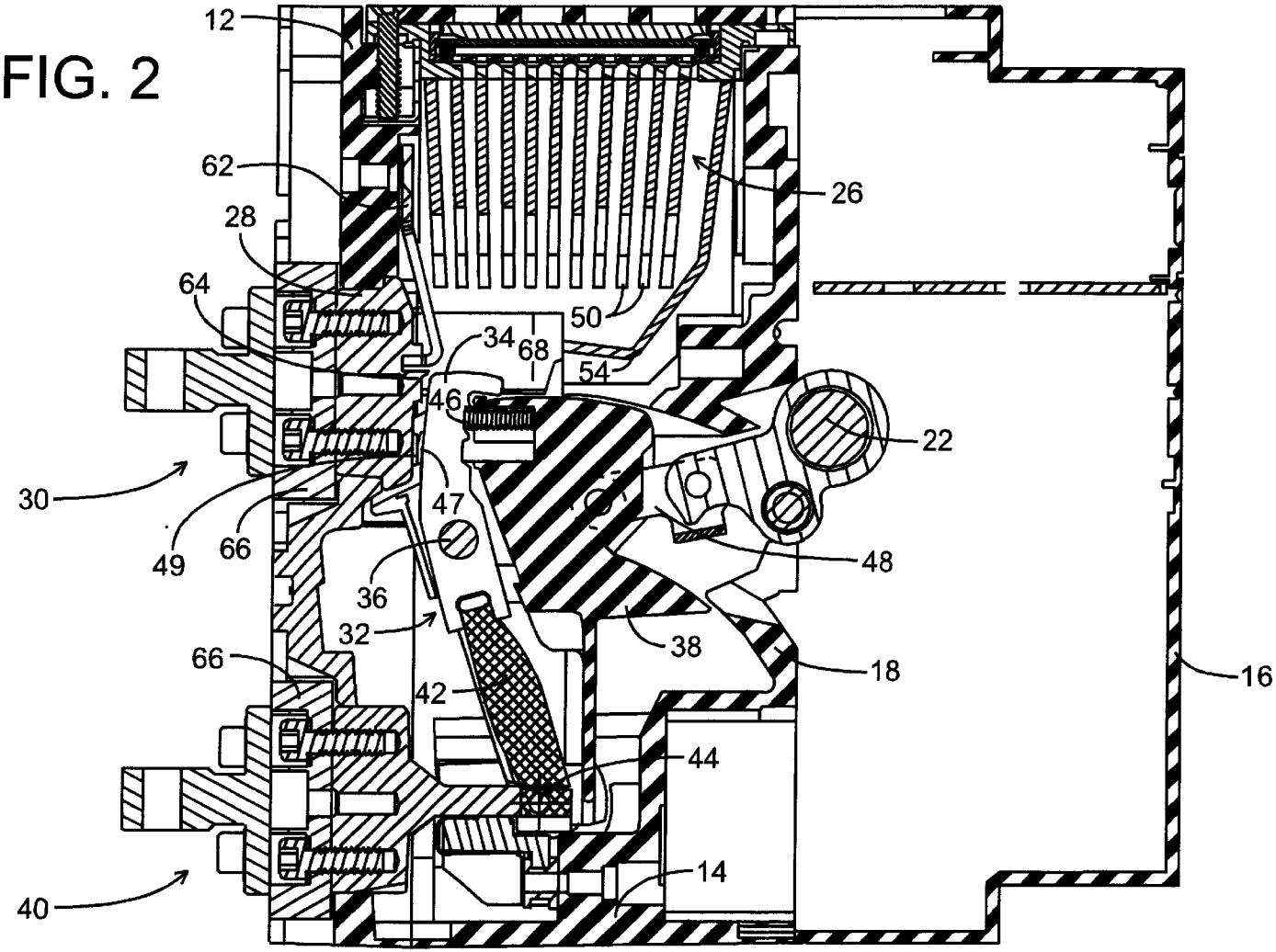
FIG. 2 represents a longitudinal cross-section of the circuit breaker of FIG. 1, according to a mid-plane of a twinned pole of the circuit breaker.

With reference to FIGS. 1 and 2, a six-pole circuit breaker 10 comprises an insulating case formed by assembly of a rear base 12, an intermediate frame 14 open at the front and rear, and a front panel 16, which confine a rear compartment and a front compartment on each side of a front partition 18 of the intermediate frame 14. An operating mechanism 20 of the circuit breaker 10 acting on a switching shaft 22 common to all the poles of the circuit breaker is housed in the front compartment. This mechanism 20 is fitted onto the front partition 18 of the intermediate frame 14.

The rear compartment is itself sub-divided into elementary compartments by intermediate partitions 24, 25 (cf. FIG. 4) of the intermediate frame 14. Each elementary compartment houses a pole of the circuit breaker. Each pole comprises a separable contact device and an arc extinguishing chamber 26.

The separable contact device comprises a stationary contact part 28 directly supported by a first connecting strip 30 of the circuit breaker passing through the base 12 of the insulating case, and a movable contact part 32. The latter is provided with a plurality of contact fingers 34 in parallel pivotally mounted on a first transverse spindle 36 of a support carrier 38. The heel of each finger is connected to a second connecting strip 40 passing through the base 12 by means of a braided strip 42 made of conducting material.

The connecting strips 30, 40 are designed to be connected to the line-side and load-side power system, for example via a busbar. The end of the carrier 38 situated close to the second connecting strip 40 is equipped with a spindle housed in a bearing securedly affixed to the insulating case, for allowing to allow pivoting of the carrier 38 between an open position and a closed position of the pole around a geometric axis 44 shown in FIG. 2. A contact pressure spring device 46 is arranged in a notch of the carrier 38 and urges the contact fingers 34 in counter-clockwise pivoting around the first spindle 36. Each contact finger 34 comprises a contact pad 47 which, in the position represented in FIG. 2, is in contact with a single pad 49 arranged on the stationary contact part 28. The carrier 38 is coupled to the switching shaft 22 by a transmission rod 48 in such a way that rotation of the shaft 22 induces pivoting of the carrier 38 around the axis 44.

Figure 3:
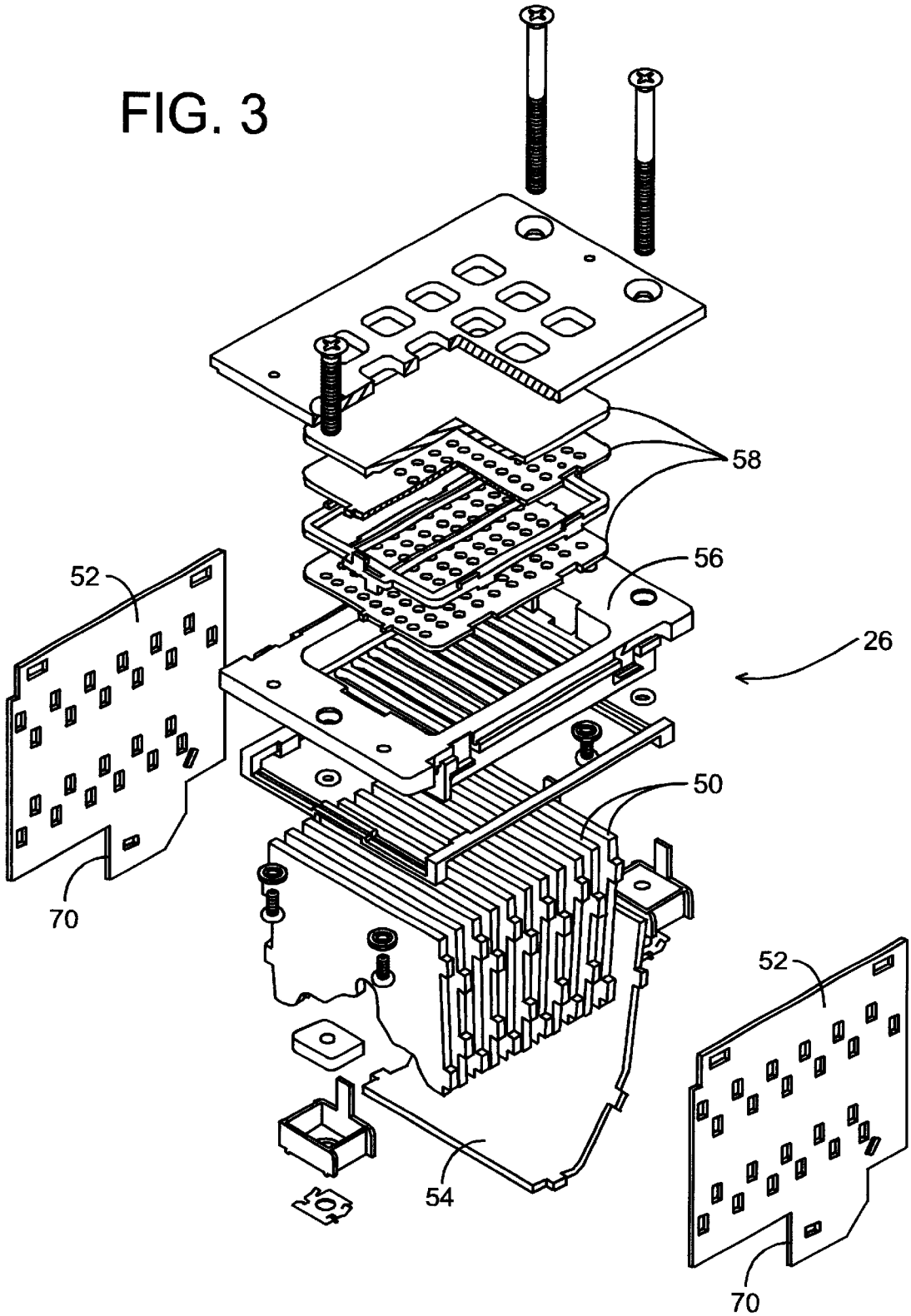
FIG. 3 represents an exploded view of an arc extinguishing chamber of a pole of the circuit breaker according to the invention.

The structure of the arc extinguishing chamber 26 can be more particularly seen in FIG. 3. The chamber comprises a stacking of metallic electrical arc deionization plates 50 assembled on an insulating support comprising two side cheeks 52. The internal face of each cheek 52 is provided with notches operating in conjunction with complementary asperities of the plates for positioning of the latter. Positioning of an upper arcing horn 54 is performed in the same way. A composite external wall 56 is located appreciably perpendicularly to the side cheeks and to the deionization plates. This wall constitutes a frame for assembly of the side cheeks. It comprises outlet orifices for removal of the breaking gases and a stack of intermediate filters 58 designed to limit pollution of the external environment.

Figure 4:
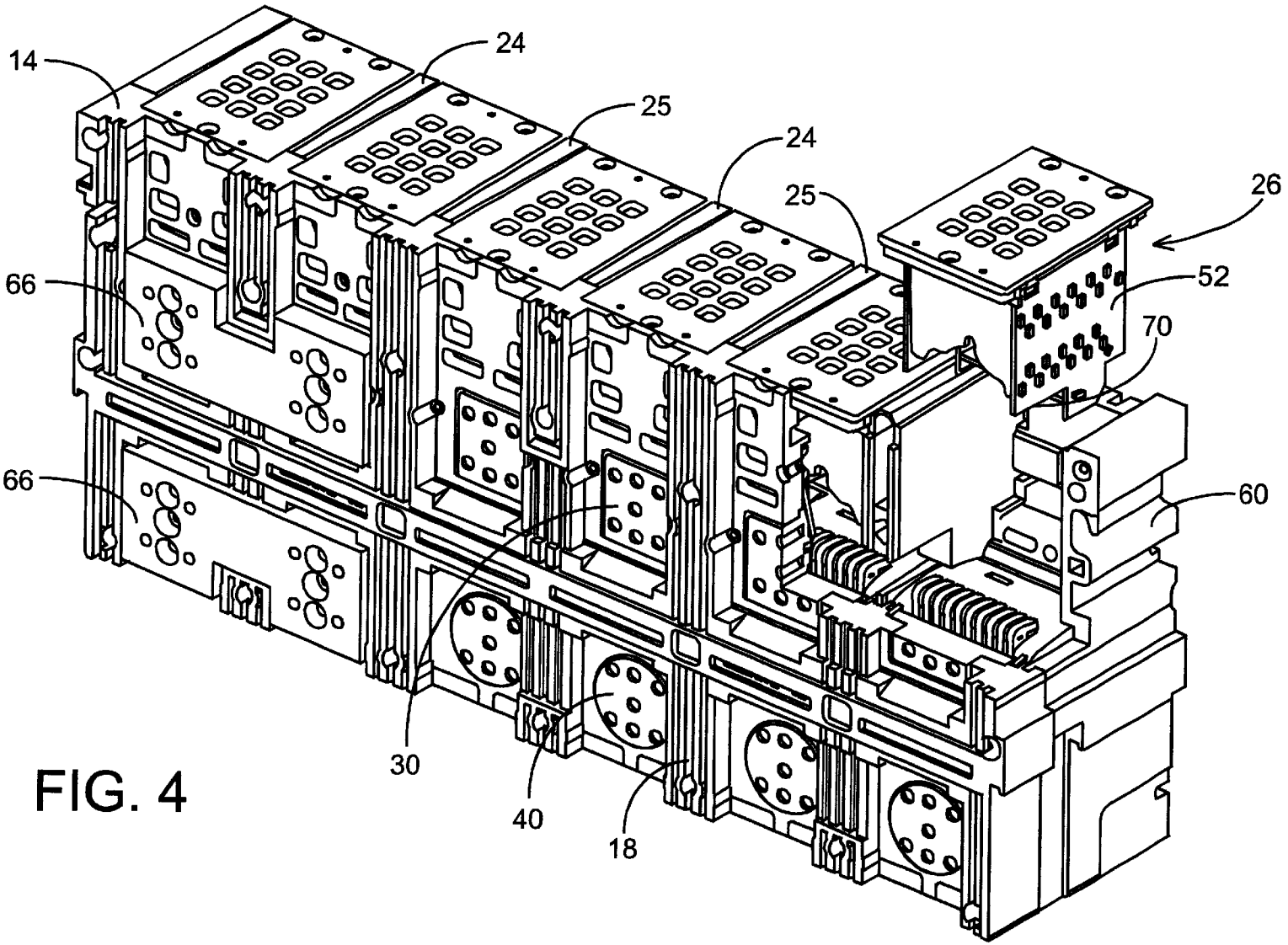
FIG. 4 represents a partially exploded perspective view of a rear compartment of the circuit breaker of FIG. 1, showing more particularly a communication orifice between two twinned poles according to the invention.

It can be seen in FIG. 4 how the arc extinguishing chamber 26 is inserted in one of the elementary compartments of the circuit breaker, here a lateral compartment bounded by an intermediate partition 24 and one of the external side partitions 60 of the intermediate frame 14. This construction enables the state of the circuit breaker poles to be checked and the arc extinguishing chamber 26 to be replaced with a reduced number of handling operations.

The extinguishing device is completed by a lower arc guiding horn 62 fixed to the base 12 and electrically connected to the stationary contact part 28 of the pole, which confines the inlet of the extinguishing chamber 26 in the downwards direction. The stationary contact 28 has, in the zone directly facing the front end of the fingers 34 of the movable contact part 32, a profiled edge 64 approximately complementary to the profile of the fingers 34, extending upwards to the protuberance of the lower horn 62 to provide globally with the latter a profile without a notable break in the slope. This zone of the stationary contact, called spark arrester, enables the risks of damage of the contact pads 47 and 49 to be eliminated. Indeed, when opening of the contact parts takes place, the initial pivoting movement of the carrier 38 around its axis 44—clockwise in FIG. 2—causes pivoting of the movable fingers 34 around their spindle 36 in the opposite direction. In this initial phase, this conjugate movement results in the front part of the fingers 34 and the spark arrester being moved towards one another and coming into contact before the contact pads 47, 49 separate. When separation of the pads 47, 49 takes place, the fingers 34 are in a position such that the distance between the pads 47, 49 increases more quickly than the distance between the lower horn 62 and the fingers 34 of the movable contact 32. The arc is consequently initially drawn between the spark arrester and the front end of the fingers 34 and immediately migrates to implant itself between the protuberance of the horn 62 and the front part of the fingers 34, preventing any displacement of the arc towards the pads 47, 49 or any striking at the level of the latter. When opening continues, the arc extends in front of the chamber and enters the latter in the usual manner.

The poles of the circuit breaker 10 are twinned in pairs so as to form three groups of two adjacent poles. By twinning we mean electrical connection in parallel of the stationary contact parts 28 of the two poles on the one hand and of the movable contact parts 32 of the two poles on the other hand. In practice, this twinning is performed outside the case at the level of the free ends of the connecting strips 30, 40 of the contacts to be connected, by interposition of two connecting strips 66 visible for one of the poles in FIG. 4, these two strips being fixed via both ends to a corresponding part of each connecting strip 30, 40, extending outside the case.

Figure 5:
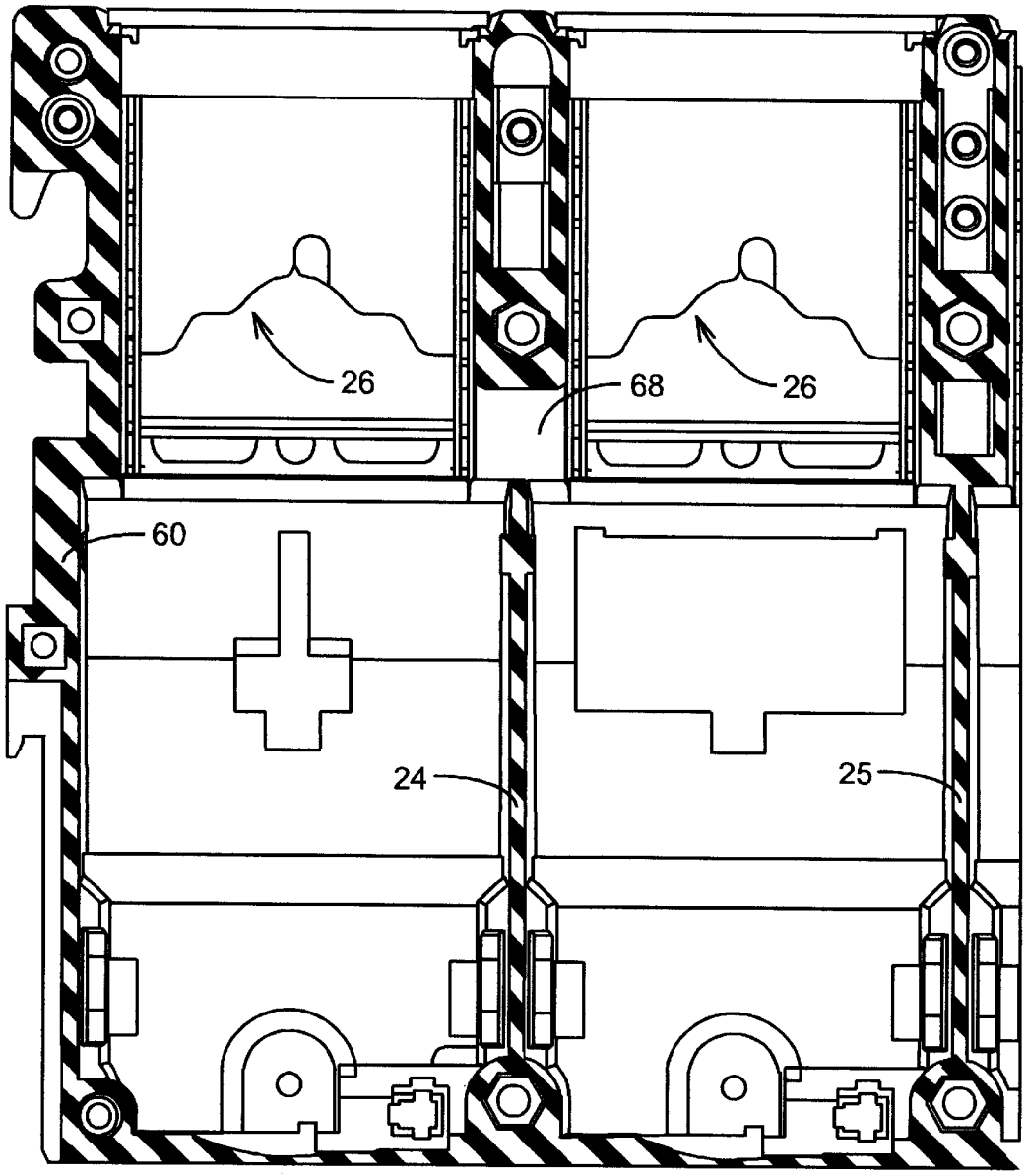
FIG. 5 represents a transverse cross section showing two twinned poles.

The three intermediate partitions 24 separating two twinned compartments differ from the other two intermediate partitions 25 in that they comprise a communicating aperture 68 of appreciably rectangular cross-section, as can be seen in FIGS. 2, 4 and 5. This aperture is situated near the contact zone, at the level of the inlet of the arc extinguishing chamber. It is arranged in such a way that the lower arcing horns 62 of the two twinned poles are facing one another on each side of the aperture. In the heightwise direction, measured according to an axis perpendicular to the base 12, the aperture 68 extends appreciably up to the height of the upper horns 54. In the lengthwise direction, measured according to an axis perpendicular to the previous axis and to the pivoting axis 44 of the movable contact part 32, the aperture extends on each side of the inlet of the chamber 26. The inlets of the two extinguishing chambers 26 are in fact not separated by the intermediate partition 24. It is thus possible to define an inlet mouth common to the two extinguishing chambers 26, which is materialized, in a straight cross-section perpendicular to the longitudinal axis, by an appreciably rectangular common orifice whose edge is defined according to the edge of the upper horn 54 of one of the poles, the edge of the upper horn 54 of this twinned pole, the protuberant upper edge of the lower horn 62 of the twinned pole, the corresponding edge of the lower horn 62 of the first pole and a part of the wall of the intermediate partition 25 with no aperture—or of the external side partition 60, depending on the case—of the first pole. As can be seen particularly in FIGS. 2 to 4, the side cheeks 52 of the extinguishing chambers 26 have a cutout 70 corresponding to the aperture 68 of the intermediate partition 24 separating the twinned poles. The face of the side cheeks 52 of each extinguishing chamber 26 facing the adjacent intermediate partition 24, 25 is adjoined over the whole surface of the partition.

The circuit breaker operates in the following manner: when a fault current occurs detected by a trip device, the operating mechanism 20 causes opening of the circuit breaker by pivoting of the switching shaft 22 which moves all the carriers 38 of the movable contact parts 32 to their open position. The initial pivoting of the carriers 38 causes rocking of the contact fingers 34 in the opposite direction. A fleeting contact is established between the front face of the fingers 34 and the spark arrester, before the contact pads 47, 49 separate. This fleeting contact lasts for a sufficiently long time after separation of the pads 47, 49 for the current to be established between the contact fingers 34 and the spark arrester. Continuation of the movement of the carrier 38 results in separation of the contact fingers 34 and of the spark arrester. An arc root arises on the spark arrester and migrates rapidly onto the lower horn 62 due to the effect of the electrodynamic forces, whereas the arc head is established on the front part of the fingers 34. At the end of opening travel of the movable contact part 32, the arc switches from the fingers 34 of the movable contact part onto the upper horn 54; at this moment, an arc is latched between the lower horn 62 and the upper horn 54. The same phenomenon does not occur at the same time on the twinned pole, which in fact does not immediately see establishment of an arc similar to that of the first pole. The whole of the current flows in the arc of one of the two compartments only. However, the presence of the communicating aperture 68 between the two compartments enables the arc to flash by breakdown and to develop with a slight delay in the deficient compartment. There is therefore distribution of the current and arcing energy between the two compartments.

Figure 6:
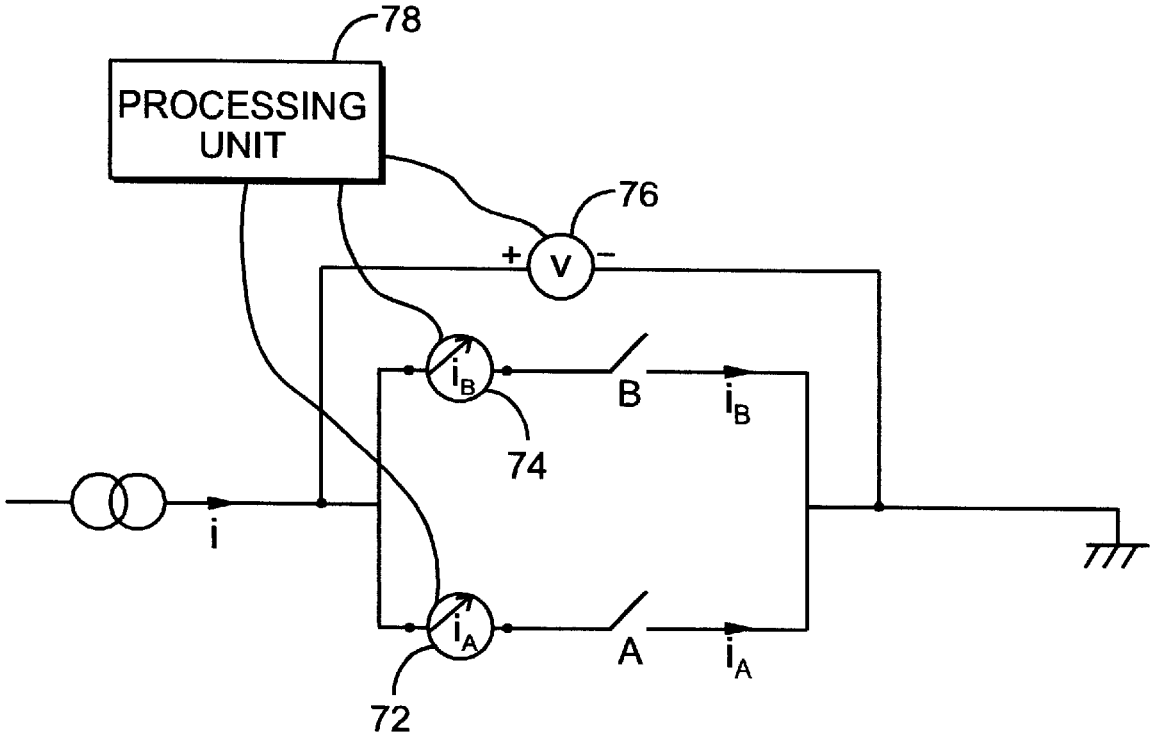
FIG. 6 represents an experimental device enabling an arcing energy to be evaluated when opening of the twinned poles takes place.
Figure 7:
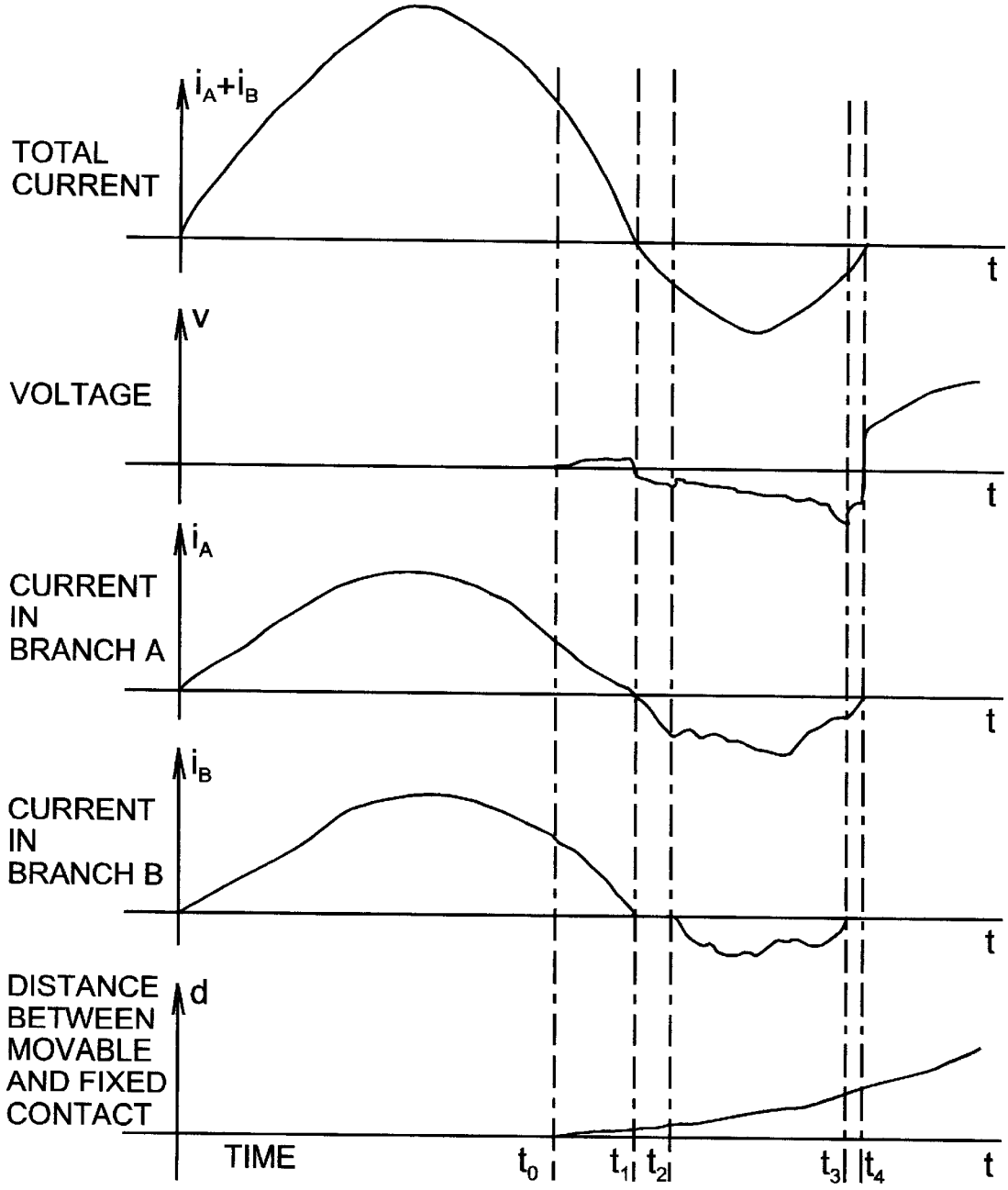
FIG. 7 represents different curves characteristic of breaking.

Comparative tests, illustrated by FIGS. 6 and 7, have enabled the efficiency of the device according to the invention to be shown. A prospective current of an rms value of 130 kA (i.e. about 270 kA peak for closing of asymmetric type with a power factor 0.2) was delivered to two poles of 3200 A rating, having an ultimate breaking capacity of 100 kA, mounted in parallel. As illustrated by FIG. 6, the instantaneous intensity of the current flowing in each pole was measured by ammeters 72, 74, and the voltage at the terminals of the poles by a voltmeter 76. The measured instantaneous values were transmitted to a processing unit 78 for computation of the energy integrals characteristic of each branch. FIG. 7 represents the curves characteristic of breaking versus time t, i.e.: the total current $i_a+i_b$ flowing in the two branches A and B of the circuit, the voltage v at the common terminals of the two twinned poles, the current intensity in each of the two branches and the distance d between the movable contact part and the stationary contact part. Before the time $t_0$, the poles were closed. The current was distributed substantially one half in each pole, i.e. 135 kA peak per pole. Opening was triggered at the time $t_0$. In the first pole A, the electrical arc occurred as from $t_0$ and continued after the time $t_1$ when the current passed 0. In the second pole B, the electrical arc occurred at $t_0$ but was extinguished when the current passed 0. Between the times $t_0$ and $t_2$, the current was flowing through the pole A only. The time $t_2$ marks restriking of the electrical arc in the pole B, as witnessed by the reappearance of a current in this branch of the circuit. Between the times $t_2$ and $t_3$, the arc exists simultaneously in the two poles which both have a current flowing through them. At $t_2$, the arcing voltage has slightly decreased before starting to increase again in absolute value. The intensity of the current in the pole B has remained in absolute value always lower than that of the pole A. Cancelling of the current at the end of a time $t_3$ in the pole B witnesses that the arc has been extinguished in this compartment. At the time $t_4$, the current has also been cancelled in the compartment A witnessing that the arc has been extinguished. The arcing voltage continued to increase in absolute value without the current reappearing. Breaking took place in less than a half-period. The arcing energy, evaluated by the integral W of the product of the current i(t) by the voltage v(t) between $t_0$ and $t_4$ in each of the two branches of the circuit shows that about ⅔ of the energy has been dissipated in the compartment A and ⅓ in compartment B. This result can moreover be read directly on the curves of FIG. 7, in which the areas bounded by the current intensity curves in the branches A and B are approximately representative of the arcing energies in each of the branches, if note is taken that the arcing voltage is common to the two branches and appreciably constant.

Under similar conditions, with a circuit breaker only differing from the previous one by the absence of aperture in the intermediate partition, the arc originated in both compartments, but was extinguished in one of the two the first time the current passed 0. Subsequently, it developed in one of the two compartments only. The arc was extinguished the second time the current passed 0 but restriking occurred almost instantaneously. Breaking was not successful and the test resulted in destruction of the pole where the arc developed. This stems from the fact that the current applied was greater than the ultimate breaking capacity of each compartment and that the energy distribution between the two compartments was very mediocre, in practice less than 1/10.

In test conditions with a current of an intensity lower than the ultimate breaking capacity of the circuit breaker without a communicating aperture, substantial difference of behavior is obtained. The following test was carried out. Taking as reference the assembly formed by the two pole compartments connected in parallel to globally constitute a single pole and comprising a communicating aperture, and in test conditions with a current of intensity I equal to 50% of the ultimate breaking capacity $I_{cu}$ of this pole, for the voltage $v_{cu}$ and power factor $k_{cu}$ used to define the ultimate breaking capacity $I_{cu}$ the ratio: of the arcing energy $W_B$ in the less solicited branch to the arcing energy $W_A$ in the more solicited branch ($W_B \leqq W_A$) between the time $t_0$ when opening begins and the time $t_4$ when the current is finally cancelled in the last compartment was measured. For a pole according to the invention, the ratio obtained when the tests were carried out was always greater than 1/6. For a pole constituted by similar compartments mounted in parallel but with no communicating aperture, the measured ratio was at best about 0.1. This means that in practice, although the arc arises in both compartments, it is extinguished in one of them at the latest the first time the current passes 0, and subsequently only persists in the other compartment. Given the favorable experimental conditions chosen, i.e. an applied current lower than the ultimate breaking capacity of a single compartment, breaking does take place, but it is very hard on the more solicited compartment.

Comparative tests were carried out with apertures of different sizes and apertures located at different places. The measurements were made for short-circuit values of 130, 150 and 180 kA single-phase under an AC voltage of 508 V with a power factor of about 0.15.

ratio $$\frac{W_B}{W_A} = \frac{\int_{t_0}^{t_4} v(t) \cdot i_B(t) dt}{\int_{t_0}^{t_4} v(t) \cdot i_A(t) dt}$$

of the values of the arcing energy generated in each of the two compartments between the time $t_0$ when opening begins and the time $t_4$ when the current is finally cancelled in the last compartment was retained as the index of distribution of the arcing energy between the two compartments and of the efficiency of the device, the ideal value being 1.

Experience shows that the efficiency of the device depends on the location of the aperture in the chamber. The efficiency decreases when the aperture is located far from the contact zone. The best results were obtained with an aperture arranged in such a way that, in the opening phase of the contacts, i.e. between the time when the movable contact leaves the stationary contact and the time it reaches its up position, at least a part of the arc, preferably its root on the stationary contact side, is facing the opening of the aperture. It is believed that the pressure and the gas flow generated by the arc are the most liable to propagate into the other chamber. If the aperture is moved towards the inside of the chamber, the arc only reaches it late, and at a time when it is already cooled, so that the probabilities of breakdown in the twinned compartment are lower. In addition, this configuration is detrimental to the rigidity of the extinguishing chamber. If on the other hand the aperture is moved towards the pads, the breakdown in the twinned compartment is liable to take place at the level of the pads, which contributes to damaging the latter.

The efficiency also varies with the size of the cross section of the aperture. A sufficient height of the aperture may be about a half of the distance between the root and the head of the arc at the end of opening, i.e., with the structure of the poles adopted for the experiment, half of the distance between the lower horn and the upper horn. However, this arrangement is only suitable for circuit breakers with relatively slow opening and relatively weak currents (less than 150 kA). For circuit breakers with faster opening and higher currents, the aperture has to be sufficiently high for the root and head of the arc to be facing the aperture at the time when the movable contact reaches its up position. In other words, the result is better when the part of the movable contacts where the head of the arc is located is facing the corresponding part of the movable contact of the twinned compartment throughout the ascending opening movement of the movable contacts. It is in fact only when the energy developed by the arc is sufficiently great, with corresponding temperature and pressure increases, that breakdown giving rise to an arc in the twinned compartment can take place. However, for extreme test parameters, and in particular a very high opening speed, these conditions are not present before the end of the ascending movement of the movable contacts. It should be underlined that the desired effect is not decreased if the height of the aperture is increased beyond the maximum height of the arc. In practice, the height of the aperture is limited by the presence of the upper horn, for which lateral securings are necessary.

As far as the width of the aperture is concerned, it should be considered that the arc, due to the electrodynamic blowing effect, tends to move towards the chamber. The results are therefore better when the aperture is wide enough for the whole of the arc to be facing it throughout the opening phase. As an indication, the width should not be less than one third of the height. Satisfactory results are obtained when the width is about a half the height. A larger width does not in itself reduce the effect sought for. However, with the previously described pole structure, the width of the aperture is limited on one side by the presence of the chamber which requires lateral support cheeks and on the other side by the presence of the contact pads which have to be preserved from the risks of rebreakdown of the electrical arc.

Naturally, a different arrangement of the poles can result in a slightly different location. Notably, if the pole is dimensioned so that the arc arises at the level of the contact pads before being blown towards the chamber, it becomes useful for the stationary contact pads to be facing one another through the aperture.

Naturally, various modifications can be made for the purpose of improving the distribution of the arcing energy even further. For example, it can be envisaged to connect the movable contact of each twinned pole with the stationary contact of the other twinned pole. It can also be envisaged to provide the orifice with a check valve allowing communication between chambers only when a certain pressure difference is exceeded. The orifice can be shaped as a neck flared at its ends to enhance the gas flow. It may also be useful to coat the edges of the aperture with a coating having a high dielectric strength, so as not to hinder development of the arc. The rectangular shape of the cross-section of the aperture used in the example described can be replaced by a different shape, provided that the dimensional criteria retained are respected. An aperture of oblong or elliptic cross section can for example be envisaged, one of whose axes has a dimension corresponding to the width in the above example and the other of whose axes has a dimension corresponding to the height in the example.

What is claimed is:

1. A circuit breaker comprising: an insulating case;

at least one pair of contiguous pole compartments, the contiguous compartments of said pair of pole compartments being separated from one another by a partition wall and juxtaposed inside said insulating case;

an arc extinguishing chamber located in each of the compartments of said pair of pole compartments;

a pair of separable contact parts located in each of said pair of pole compartments;

means for electrically connecting in parallel each contact part of the pair of separable contact parts located in one of the pole compartments with a corresponding contact part of the pair of separable contact parts located in the other pole compartment;

at least one communicating aperture located in the partition wall distributing arcing energy between the two contiguous compartments of said pair of pole compartments;

a lower arcing horn located in each contiguous compartment of said pair of pole compartments;

the arc extinguishing chamber of each of the contiguous compartments of said pair of pole compartments including an inlet opening outwardly from a side of the compartment where the contact parts are located, the inlet being confined in one direction by said lower arcing horn, said lower arcing horn being located to receive a foot of an electrical arc at its entry into the chamber; and wherein the aperture is located and has dimensions such that the lower arcing horns in the contiguous compartments of said pair of pole compartments are located facing one another on each side of the aperture.

2. A circuit breaker comprising: an insulating case;

at least one pair of contiguous pole compartments, the contiguous compartments of said pair of pole compartments being separated from one another by a partition wall and juxtaposed inside said insulating case;

an arc extinguishing chamber located in each of the contiguous compartments of said pair of pole compartments;

a first pair of separable contact parts located in one of the contiguous compartments of said pair of pole compartments;

a second pair of separable contact parts located in the other of the contiguous compartments of said pair of pole compartments;

an operating mechanism linked to the first and second pairs of separable contact parts to cause the first and second pairs of contact parts to separate simultaneously;

means for electrically connecting in parallel each contact part of the first pair of separable contact parts with a corresponding contact part of the second pair of separable contact parts, and forming a single pole of ultimate breaking capacity $l_{cu}$ for a voltage $v_{cu}$ and power factor $k_{cu}$;

a lower arcing horn located in each contiguous compartment of said pair of pole compartments;

the arc extinguishing chamber of each of the contiguous compartments of said pair of pole compartments including an inlet opening outwardly from a side of the compartment where the contact parts are located, the inlet being confined in one direction by said lower arcing horn, said lower arcing horn being located to receive a foot of an electrical arc at its entry into the chamber; and at least one communicating aperture located in the partition wall, said aperture having dimensions and a location such that, when a current of an intensity equal to 50% of the ultimate breaking capacity $I_{cu}$ of the pole for a voltage $v_{cu}$ and power factor $k_{cu}$ flows through the pole, the ratio of the arcing energy in one of the contiguous compartments of said pair of pole compartments to the other of the contiguous compartments of said pair of pole compartments is greater than ⅙, the arcing energy being measured for each compartment by the integral $$W=\int_{t_0}^{t_4} v(t).i(t)dt$$

where:

W is the integral measuring the arcing energy, v(t) is the instantaneous value of the voltage at the terminals of the contact parts, i(t) is the instantaneous value of the current intensity flowing through the contact parts, $t_0$ is the time when separation of the contact parts begins, $t_4$ is the time when the current intensity flowing through the contact parts ceases; and wherein the aperture is located and has dimensions such that the lower arcing horns in the contiguous compartments of said pair of pole compartments are located facing one another on each side of the aperture.

3. The circuit breaker according to claim 1 or 2, wherein the aperture is located close to a zone of each compartment of said pair of compartments where an arc is drawn when the contact parts separate.

4. The circuit break according to claim 1 or 2, wherein an upper arcing horn is arranged in each of the contiguous compartments of said pair of compartments, said upper arcing horn facing the lower arcing horn so that the inlet of the extinguishing chamber is confined between the lower and upper arcing horns, said upper arcing horn being designed to receive a head of the electrical arc at its entry into the chamber; and the aperture is located and has dimensions such that a zone situated between the lower arcing horn and the upper arcing horn of one of said compartments, is facing a zone located between the lower arcing horn and the upper arcing horn of the other one of said compartments on each side of the aperture.

5. The circuit breaker according to claim 1, wherein the opening of the aperture in each compartment is located close to a contact zone of the pairs of separable contact parts, where the separable contact parts contact each other.

6. The circuit breaker according to claim 1, wherein one contact part of each pair of contact parts is movable between a closed position, in which the contact part is in contact with the other contact part of the same pair of contact parts, and an open position, and comprises a front end on which the head of an electrical arc is located when separation of the contact parts takes place; and the dimensions of the aperture are such that the front end of the movable contact part in one of the compartments of said pair of compartments is facing the front end of the movable contact part in the other compartment of said pair of compartments, in both the closed position and in the open position.

7. The circuit breaker according to claim 1, wherein each pair of separable contact parts comprises a stationary contact part, the aperture being located close to the stationary contact part in each compartment.

8. The circuit breaker according to claim 1 or 2, wherein the partition wall has a high dielectric strength.

9. The circuit breaker according to claim 2, wherein the opening of the aperture in each compartment is located close to a contact zone of the first and second pairs of separable contact parts, where the separable contact parts contact each other.

10. The circuit breaker according to claim 2, wherein one contact part of each of said first and second pairs of contact parts is movable between a closed position, in which the contact part is in contact with the other contact part of the same pair of contact parts, and an open position, and comprises a front end at which the head of an electrical arc is located when separation of the contact parts takes place; and the dimensions of the aperture are such that the front end of the movable contact part in one of the contiguous compartments of said pair of compartments is facing the front end of the movable contact part in the other compartment of said pair of compartments, in both the closed position and in the open position.

11. The circuit breaker according to claim 2, wherein each of said first and second pairs of separable contact parts comprises a stationary contact part, the aperture being located close to the stationary contact part in each compartment.

* * * * *